US011145997B1

(12) United States Patent
Chen

(10) Patent No.: US 11,145,997 B1
(45) Date of Patent: Oct. 12, 2021

(54) CONNECTION TERMINAL

(71) Applicant: Xiamen Ghgm Electric Co., Ltd., Xiamen (CN)

(72) Inventor: Bingshui Chen, Xiamen (CN)

(73) Assignee: XIAMEN GHGM ELECTRIC CO., LTD., Xiamen (CN)

( * ) Notice: Subject to any disclaimer, the term of this patent is extended or adjusted under 35 U.S.C. 154(b) by 0 days.

(21) Appl. No.: 16/910,445

(22) Filed: Jun. 24, 2020

(30) Foreign Application Priority Data

May 21, 2020 (CN) ..... 202010434764.7

(51) Int. Cl.
*H01R 4/48* (2006.01)

(52) U.S. Cl.
CPC ..... *H01R 4/4809* (2013.01); *H01R 4/4818* (2013.01)

(58) Field of Classification Search
None
See application file for complete search history.

(56) References Cited

U.S. PATENT DOCUMENTS 4,397,514 A * 8/1983 Durand ..... H01R 4/4818 439/436
5,975,940 A * 11/1999 Hartmann ..... H01R 4/4818 439/441
6,746,286 B2 * 6/2004 Blaha ..... H01R 4/4809 439/436
7,507,106 B2 * 3/2009 Keswani ..... H01R 4/4818 439/439
7,731,522 B2 * 6/2010 Keswani ..... H01R 4/4818 439/439
2019/0199011 A1 * 6/2019 Koellmann ..... H01R 13/506
2021/0005986 A1 * 1/2021 Urbaniak ..... H01R 4/4818

* cited by examiner

*Primary Examiner* — Felix O Figueroa

(57) ABSTRACT

A novel connection terminal includes a housing, a contact assembly and a support member. The conductive clip is integrally bent and formed by spring steel plate, and two ends of a tongue forming section of the conductive clip are respectively connected to a supporting section and an approximately C-shaped cavity section by a pre-deformed elastic arch structure. Thus, the conductive clip and the bus bar form a clamping space in which the conducting wire can be more elastically crimped, ensuring that the conducting wire is firmly connected to the connection terminal assembly, allowing stable electrical connection between multiple conducting wires. The interior of the approximately C-shaped cavity section communicating with the wire passage enlarges the accommodating space for the conducting wire accordingly, facilitates the quick insertion of the conducting wire and provides more elastic and effective pressing force.

16 Claims, 13 Drawing Sheets

CONNECTION TERMINAL

CROSS-REFERENCE TO RELATED APPLICATIONS

The present application claims the benefit under 35 U.S.C. § 119 of China Patent Application No. 202010434764.7, filed on May 21, 2020, in the China National Intellectual Property Administration, the content of which is hereby incorporated by reference.

TECHNICAL FIELD

The present disclosure relates to the technical field of connectors, in particular, to a novel connection terminal.

BACKGROUND

A connection terminal, also known as a plug-in terminal or plug-in connector, is an electrical device that can be used to join two or more conducting wires and allow these wires to be electrically connected with power devices. Generally, the contact of such a connection terminal is generally composed of a spring steel plate and a bus bar which is made of a material with good electrical conductivity and shared by a clamping part. A plurality of elastic tongues in the form of leaf spring tongues are punched or punched out of the spring steel plate block corresponding to the number of clamping parts. The spring plate and the bus bar together form a clamping point in order to electrically and mechanically clamp a conducting wire inserted into the connection terminal.

The bus bar is a contact plate made of copper with good electrical conductivity and a certain rigidity. The contact plate is the carrier element of the contact assembly, and the bus bar is placed in a spring steel plate with punched-out elastic tongues. The conducting wire to be clamped first enters the wire passage through the insertion hole, so that the inserted conducting wire with insulation sheath peeled off is crimped in the contact assembly by means of corresponding elastic tongues.

This type of terminal is widely used in power devices. However, successful products must also comply with market requirements, such as low production costs and structure miniaturization. The structure of the connector is not compact enough, it is difficult to operate the insertion of the conducting wire and the stability after the conducting wire is installed is poor, resulting in unstable wiring and difficulty to insert the conducting wire. During long-term use, the contact assembly may not be able to make good contact with the conducting wires, affecting the normal operation of the connector.

SUMMARY

A novel connection terminal for electrically connecting at least two wires, comprises: a housing provided with a mounting cavity, a contact assembly arranged in the mounting cavity, and a support member detachably arranged in the mounting cavity and provided with insertion holes. The contact assembly comprises a conductive clip and a bus bar. The conductive clip is provided with at least two wire passages and elastic tongues corresponding to the wire passages. The bus bar is inserted into the wire passage and supported in the housing. The conductive clip is arranged in the mounting cavity with an opening facing the support member and is assembled to the mounting cavity via the support member. The conducting wires with insulation sheath peeled off can pass through the insertion holes in such a way that the conducting wires are located between the conductive clips and the bus bar and be inserted into the wire passages, so that the elastic tongues are pressed upon the conducting wire. The conductive clips are integrally bent and formed by spring steel plates, and each has a supporting section, a tongue forming section, an approximately C-shaped cavity section and an extension section that are connected in sequence. The supporting section abuts against the support member, and the supporting section and the tongue forming section are connected by a pre-deformed first elastic arch. The elastic tongues spaced apart each is formed by punching of the tongue forming section, the tongue forming section is connected to one end of the approximately C-shaped cavity section through a pre-deformed second elastic arch, the other end of the approximately C-shaped cavity section extends horizontally with an extension section, and the wire passage communicates with an interior of the approximately C-shaped cavity section. Two ends of the tongue-forming section are respectively connected to the supporting section and the approximately C-shaped cavity section through a pre-deformed arch structure, so that a clamping space can be formed between the conductive clip and the bus bar, and the conducting wires with insulating sheath peeled off can be elastically pressed in the clamping space.

In some embodiments, arched portions of the first elastic arch and the second elastic arch are oriented towards the direction in which the conducting wires are pressed, so that the opening of the conductive clip can be expanded outwardly.

In some embodiments, the elastic tongue has a connection end fixed to the spring steel plate and a free end extending close to the wire passage. From the connection end to the free end, the elastic tongue is of an arch-shaped bending structure, and at least two linear bending sections are provided to be pre-deformed and folded back to the crimped conducting wire. The arch-shaped bending of the elastic tongue is arranged to be facing the arch-shaped bending formed by the supporting section and the tongue forming section.

In some embodiments, an end of the free end is located outside a cavity formed by the approximately C-shaped cavity section in an initial state, a height difference exists between the free end and the connection end, and the conducting wire is inserted into the wire passage, making the height difference smaller.

In some embodiments, the elastic tongue is formed by punching is provided with a window gap formed on the spring steel plate located in the tongue forming section, and the window gap communicates correspondingly to the wire passage.

In some embodiments, two ends of the approximately C-shaped cavity section are arranged in parallel, and corners thereof are all connected at an R angle. An interior of the approximately C-shaped cavity is provided with an elastic protrusion corresponding to the wire passage, and the bus bar inserted into the wire passage is supported on the elastic protrusion.

In some embodiments, the elastic protrusion, the wire passage and the elastic tongue correspond to each inserted conducting wire in a one-to-one correspondence.

In some embodiments, the bus bar is formed by bending through a conductive sheet structure, the bus bar has a head that cooperates with the wire passage and extends outside the passage and a bent portion disposed on a side away from the head.

In some embodiments, the support member is detachably arranged in the mounting cavity through a quick release structure. The quick release structure comprises a convex block and a clamping slot adapted to the convex block.

In some embodiments, a front end surface of the support member that abuts against the conductive clip is provided with a partition part corresponding to an end of the elastic tongue, and the partition part is located between the elastic tongue and the insertion hole.

By adopting the above technical solutions, the present disclosure can achieve the following technical effects:

For the connection terminal of the present application, the conductive clip is formed by an integrally bent spring steel plate, and the two ends of the tongue forming section of the conductive clip are respectively connected to the supporting section and the approximately C-shaped cavity section through a pre-deformed elastic arch structure, so that the conductive clip and the bus bar form a clamping space, and the conducting wire A with insulation sheath peeled off can be more elastically crimped in the clamping space, ensuring firm connection of the conducting wire A to the connection terminal assembly and thus stable electrical connection among multiple wires A. In addition, the interior of the approximately C-shaped cavity section communicating with the wire passage is an inner cavity of approximately C-shaped structure, so as to correspondingly enlarge the accommodating space for the conducting wire A, so that the conducting wire A placed in the wire passage and crimped at the contact assembly is stably located in the clamping space, which facilitates quick insertion of the conducting wire A and provides a more elastic and effective pressing force.

Further, the openings of the conductive clips are expanded outwardly by orientation of the first elastic arch and the second elastic arch towards the conductor A. Correspondingly, the elastic tongue is an arch-bridge like bent structure, and has at least two bending sections that are pre-deformed and folded back to the crimping wire A, so that the arched bend of the elastic tongue faces the arched bend formed by the supporting end and by the tongue forming section of the conductive clip. The conducting wire A elastically crimped at the free end of the elastic tongue is subjected to the common elastic bending action of the two arch bends. When the conducting wire A with insulation sheath peeled off is inserted into the wire passage along the insertion hole and elastically crimped in the clamping space, the arch-bridge shaped bend of the elastic tongue makes the end of the conducting wire A abut and drive the free end of the elastic tongue to be lifted upwards, and at the same time, the elastic tongue is disposed on another arch-bent tongue forming section, which correspondingly drives the conductive clip to be pre-deformed outwardly, so as to facilitate the positive insertion and installation of the conducting wire A. When the conducting wire A is elastically crimped in the clamping space, it is twisted and pulled in the opposite direction of the insertion direction of the conducting wire A to disengage from the inside of the connection terminal. At this time, the free end of the elastic tongue piece bent in an arch-bridge shape and elastically crimped on the conducting wire A presses the conducting wire downward elastically, and drives the tongue forming section to make the conductive clip pre-deformed inwardly to clamp the conducting wire A in the clamping space. In this way, a clamping force is provided that prevents the conducting wire A from pulling out, further ensuring stable connection of the conducting wire A in the clamping space, which satisfies twist and pull test of the conducting wire A in the connection terminal.

BRIEF DESCRIPTION OF THE DRAWINGS

In order to illustrate the technical solutions of the embodiments of the present disclosure more clearly, the drawings used in the embodiments will be briefly described below. It shall be understood that the following drawings illustrate only certain embodiments of the present disclosure. Therefore, it should not be deemed as limiting the scope, and those skilled in the art may obtain other related drawings according to these drawings without any creative work.

DETAILED DESCRIPTION OF EMBODIMENTS

Figure 1:
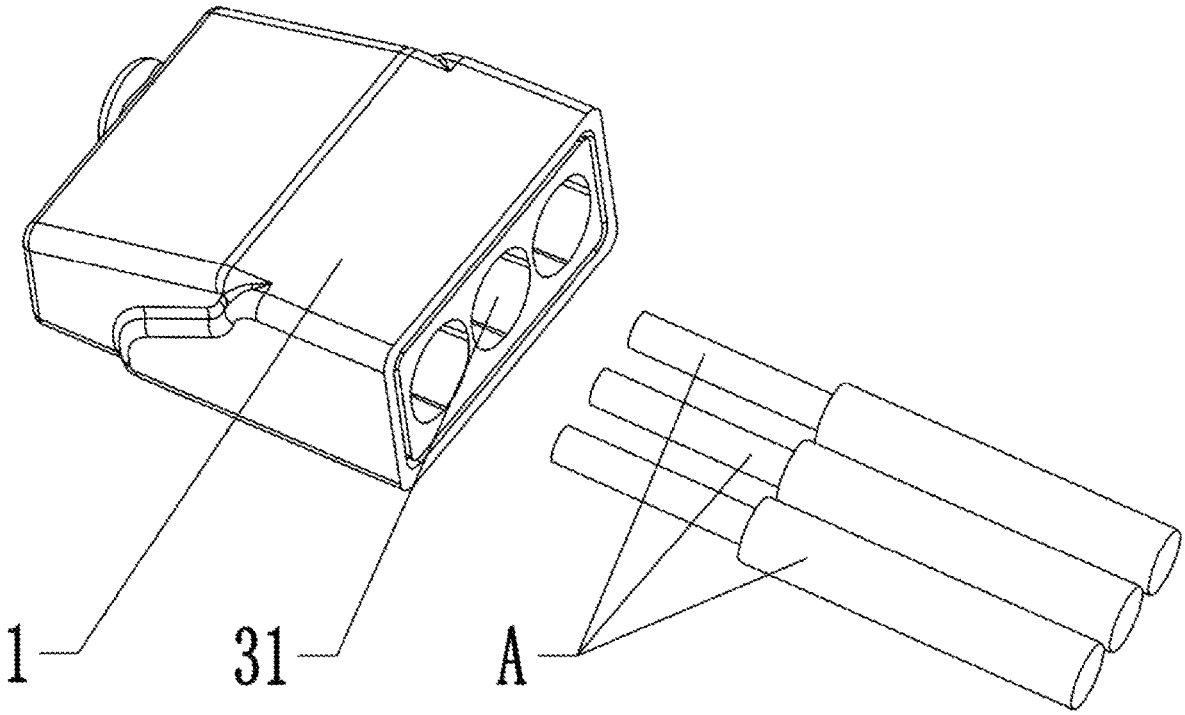
FIG. 1 is a state view of a connection terminal and a conducting wire of an embodiment of the present disclosure in use.
Figure 2:
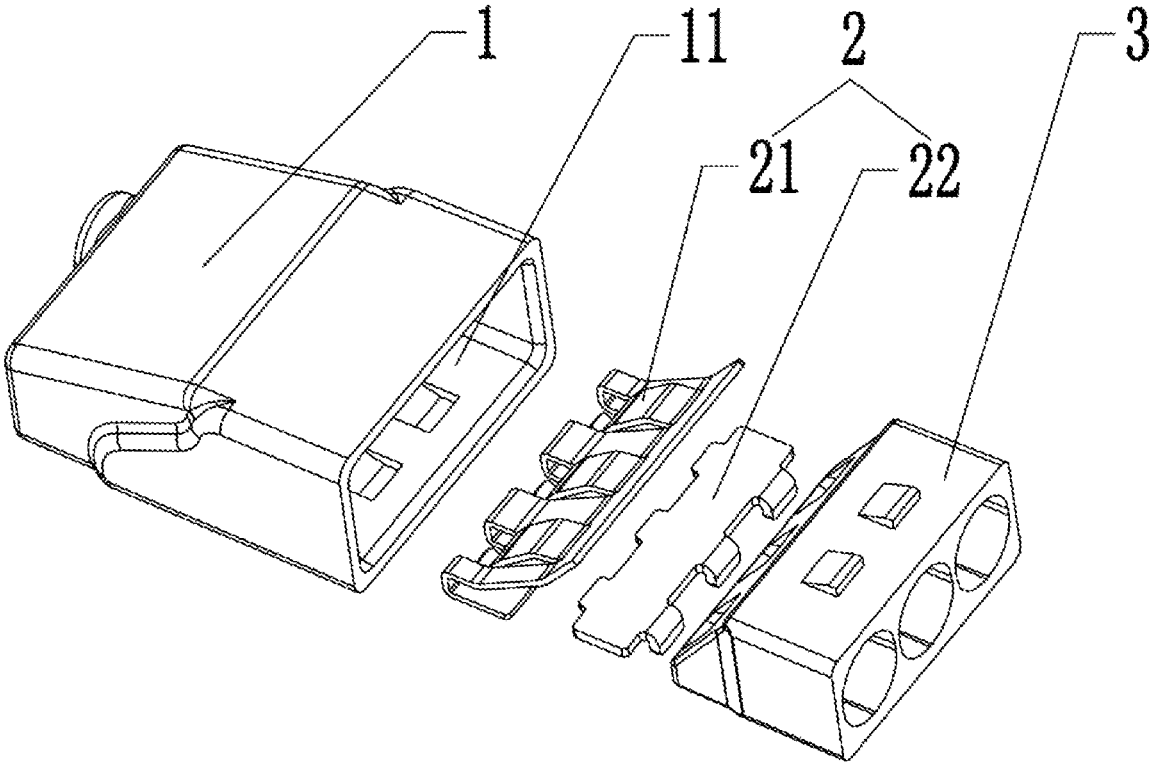
FIG. 2 is a schematic view of the connection terminal in FIG. 1 in a disassembled state.
Figure 3:
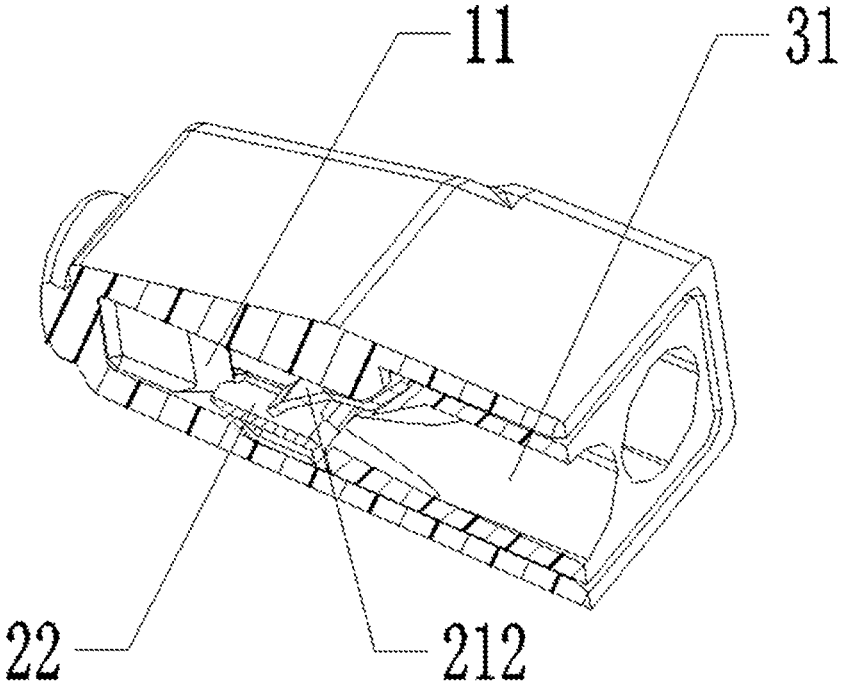
FIG. 3 is a cross-sectional view of the connection terminal in FIG. 1.

The embodiments of the present disclosure will be clearly and completely described in conjunction with the drawings of the embodiments of the present disclosure. Apparently, what is described are some but not all of the embodiments of the present disclosure. All other embodiments obtained by a person of ordinary skill in the art based on the embodiments of the present disclosure without creative efforts are within the scope of the present disclosure. Therefore, the following detailed description of the embodiments of the present disclosure are not intended to limit the scope of the present disclosure, but to explain the selected embodiments of the present disclosure. All other embodiments obtained by a person of ordinary skill in the art based on the embodiments of the present disclosure without creative efforts are within the scope of the present disclosure.

In the description of the present disclosure, it is to be understood that the orientational or positional relationships indicated by the terms "center", "longitudinal", "transversal", "length", "width", "thickness", "upper", "lower", "front", "rear", "left", "right", "vertical", "horizontal", "top", "bottom", "inside", "outside", "clockwise", "counterclockwise", etc. are based on the orientation or positional relationship shown in the drawings, are merely for the convenience of describing the present disclosure and simplifying the description, and do not indicate or imply that the device or component referred to must have a specific orientation or be constructed and operated in a specific orientation. Therefore, it should not be construed as limiting the present disclosure.

Moreover, the terms "first" and "second" are used for descriptive purposes only and are not to be construed as indicating or implying a relative importance or implicitly indicating the number of technical features indicated. Thus, features defining "first" and "second" may include one or more of the features either explicitly or implicitly. In the description of the present disclosure, the meaning of "a plurality" is two or more unless specifically defined otherwise.

In the present disclosure, the terms "install", "connected", "connect", "fix" and the like shall be understood broadly. For example, the connection may be a fixed connection or a detachable connection or integration; may be a mechanical connection or an electrical connection; may be directly connected, may be indirectly connected through an intermediate medium, or may be an internal communication of two elements or the interaction of two elements, unless explicitly stated and defined otherwise. For those skilled in the art, the specific meanings of the above terms in the present disclosure can be understood based on specific situations.

In the present disclosure, when a first feature is described to be "on" or "under" a second feature, situations may include direct contact of the first and second features, and may also include indirect contact of first and second features through another feature therebetween, unless otherwise specifically defined and defined. Moreover, when a first feature is described to be "over", "above" and "on" the second feature, situations include that the first feature is directly not directly above the second feature, or that the first feature is merely located higher than the second feature. When a first feature is described to be "under", "below" and "down" the second feature, situations include that the first feature is directly or not directly below the second feature, or that the first feature is merely located lower than the second feature.

The present disclosure will be described in further detail below with reference to the drawings and specific embodiments:

With reference to FIGS. 1 to 8, this embodiment provides a novel connection terminal for electrically connecting at least two connection wires A. The connection terminal comprises a housing 1 in which a mounting cavity 11 is opened, a contact assembly 2 arranged in the mounting cavity 11, and a support member 3, which is detachably arranged in the mounting cavity 11 and in which an insertion hole 31 is opened.

In this embodiment, the contact assembly 2 comprises a conductive clip 21 and a bus bar 22. The conductive clip 21 is provided with at least two wire passages 211 and elastic tongues corresponding to the wire passages 211. The bus bar 22 is inserted into the wire passages 211 and supported in the housing 1. The conductive clip 21 is arranged in the mounting cavity 11 with the opening facing the support member 3, and is assembled to the mounting cavity 11 via the support member 3. The conducting wire A with insulation sheath peeled off can pass the insertion hole 31 in a way between the conductive clip 21 and the bus bar 22 and be inserted into the wire passage 211, so that the elastic tongue 212 is crimped to the conducting wire A. Specifically, the conductive clip 21 is integrally formed by bending a spring steel plate, and has a supporting section 213, tongue forming sections 214, approximately C-shaped cavity sections 215, and an extension section 216. The supporting section 213 is matched with the support member 3, and the supporting section 213 and the tongue forming sections 214 are connected by pre-deformed first elastic arches 217. The tongue forming sections 214 form elastic tongues 212 arranged at intervals through punching, and one end of each of the tongue forming sections 214 is connected to one end of each of the approximately C-shaped cavity sections 215 by a pre-deformed second elastic arch 218, the other end of each of the approximately C-shaped cavity sections 215 extends horizontally with an extension section 216, and the wire passage 211 communicates with the interior of each of the approximately C-shaped cavity sections 215. The two ends of the tongue forming section 214 are respectively connected to the supporting section 213 and the approximately C-shaped cavity section 215 through a pre-deformed arch structure, and the conductive clip 21 and the bus bar 22 form a clamping space, and the conducting wire A with insulation sheath peeled off can be elastically crimped in the clamping space.

In this embodiment, the conductive clip 21 is formed by an integrally bent spring steel plate, and the two ends of the tongue forming section 214 of the conductive clip 21 are respectively connected to the supporting section 213 and the approximately C-shaped cavity section through a pre-deformed elastic arch structure 215, so that the conductive clip 21 and the bus bar 22 form a clamping space, and the conducting wire A with insulation sheath peeled off can be more elastically crimped in the clamping space, ensuring firm connection of the conducting wire A to the connection terminal assembly and thus stable electrical connection among multiple wires A. In addition, the interior of the approximately C-shaped cavity section 215 communicating with the wire passage 211 is an inner cavity of approximately C-shaped structure, so as to correspondingly enlarge the accommodating space for the conducting wire A, so that the conducting wire A placed in the wire passage 211 and crimped at the contact assembly 2 is stably located in the clamping space, which facilitates quick insertion of the conducting wire A and provides a more elastic and effective pressing force.

It should be mentioned that the approximately C-shaped cavity section 215 may be a different frame structure with a shape close to that of the C-shape, for example, a frame structure similar to the C-shaped with a certain bending angle. In this embodiment, the frame structure enclosing an approximately C-shaped cavity section 215 is a regular semi-enclosed rectangular structure, and the corners are connected at an R angle, so that both ends of the approximately C-shaped cavity section 215 are parallel, which facilitates the connection and expands the clamping space accordingly.

In an embodiment of the present disclosure, the arched portions of the first elastic arch and the second elastic arch 218 are oriented in a direction close to the crimping wire A, so that the opening of the conductive clip 21 is expanded outwardly. The first elastic arch 217 connects the supporting section 213 and the tongue forming section 214, and the arched portion of the first elastic arch 217 protrudes towards the interior of the conductive clip 21, so that the supporting section 213 and the tongue forming section 214 form an obtuse angle, ensuring that the supporting section 213 faces upward and outward to expose the opening. Correspondingly, the second elastic arch 218 makes the tongue-forming section 214 and one horizontally disposed end of the approximately crater-shaped cavity section 215 form an obtuse angle, and under the joint guidance of the two elastic arch structures, the tongue-forming section 214 and the supporting section 213 constituting the conductive clip 21 make the opening of the conductive clip 21 correspondingly expanded outwardly to form an arch bridge bending structure.

Figure 4:
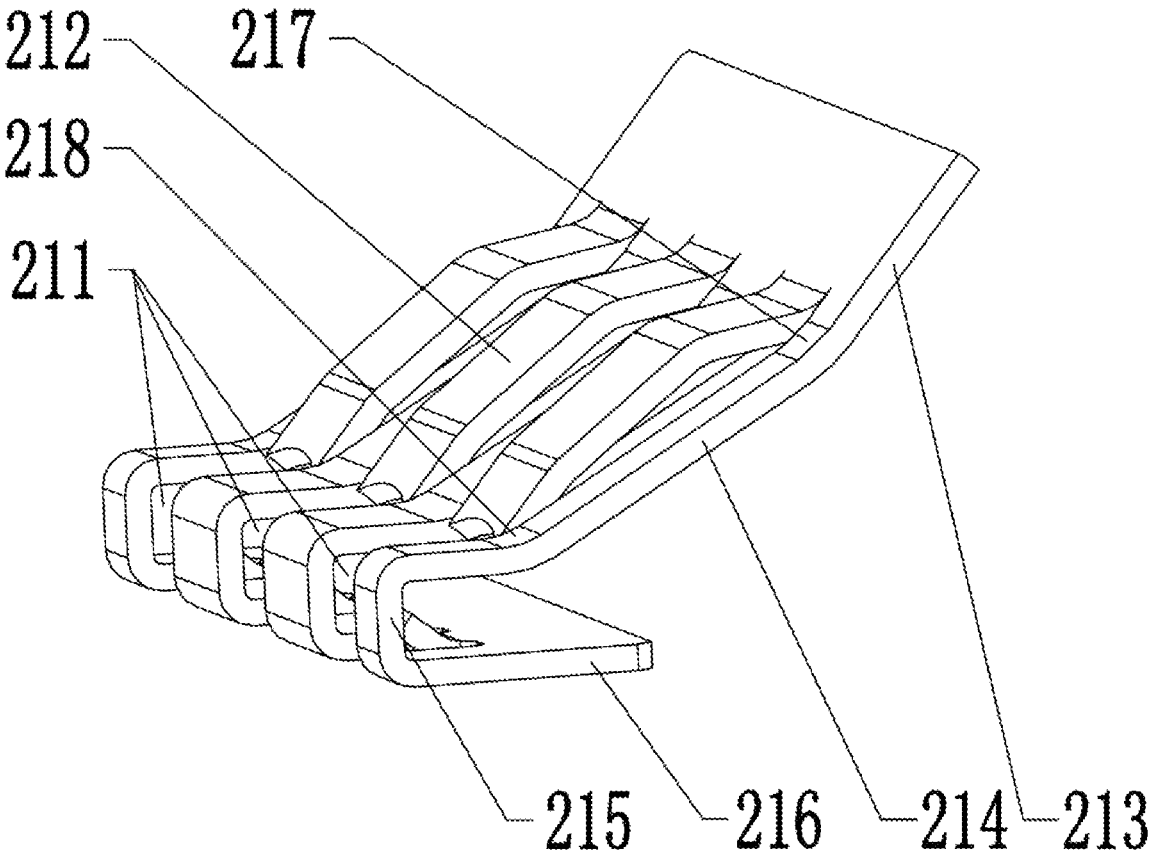
FIG. 4 is a schematic structural view of a conductive clip of a connection terminal according to an embodiment of the present disclosure from a first perspective.
Figure 5:
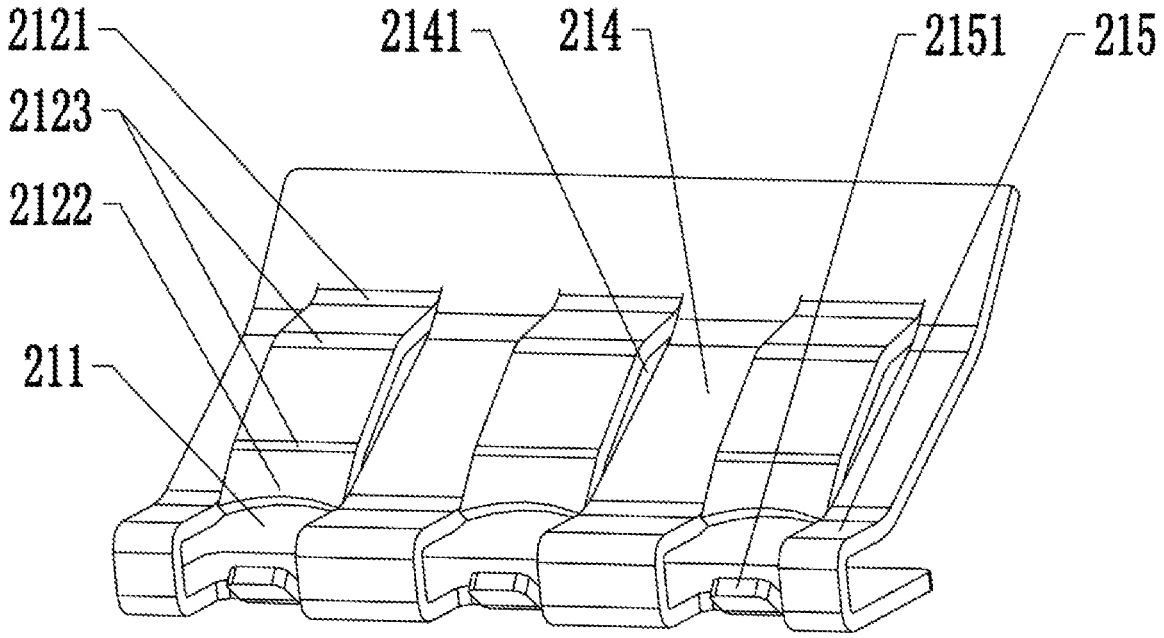
FIG. 5 is a schematic structural view of a conductive clip of a connection terminal according to an embodiment of the present disclosure from a second perspective.
Figure 6:
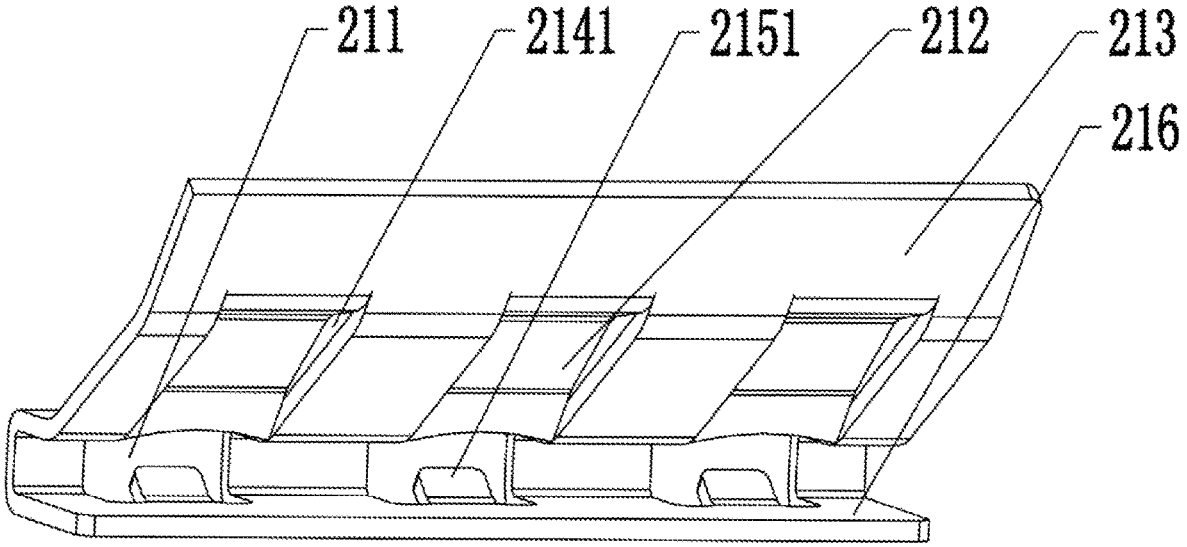
FIG. 6 is a schematic structural view of a conductive clip of a connection terminal according to an embodiment of the present disclosure from a third perspective.
Figure 7:
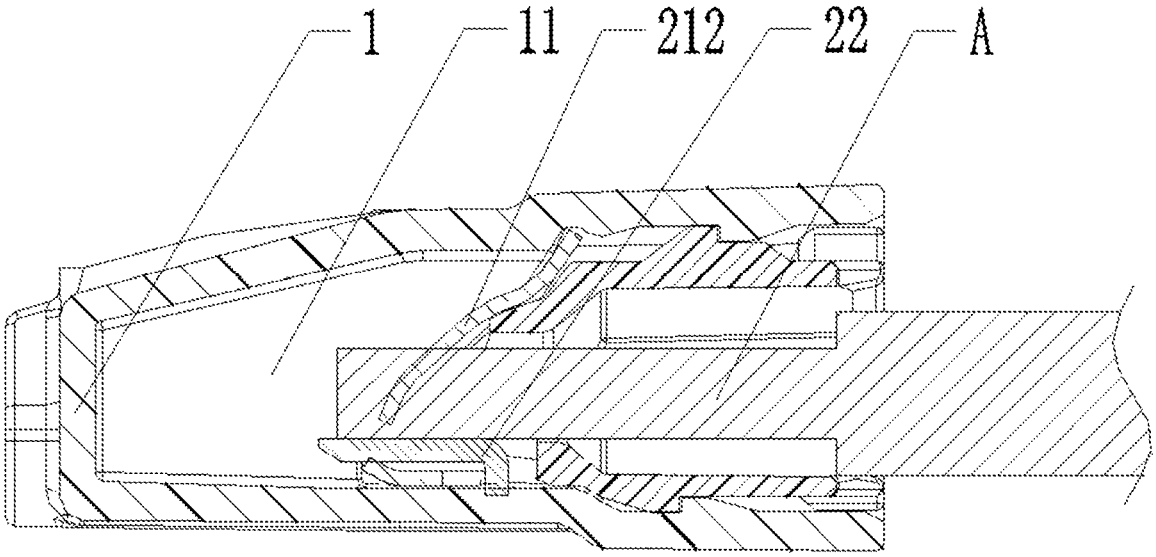
FIG. 7 is a cross-sectional view of the connection terminal and the conducting wire in use of an embodiment of the present disclosure, in which the conducting wire is inserted into the clamping space.
Figure 8:
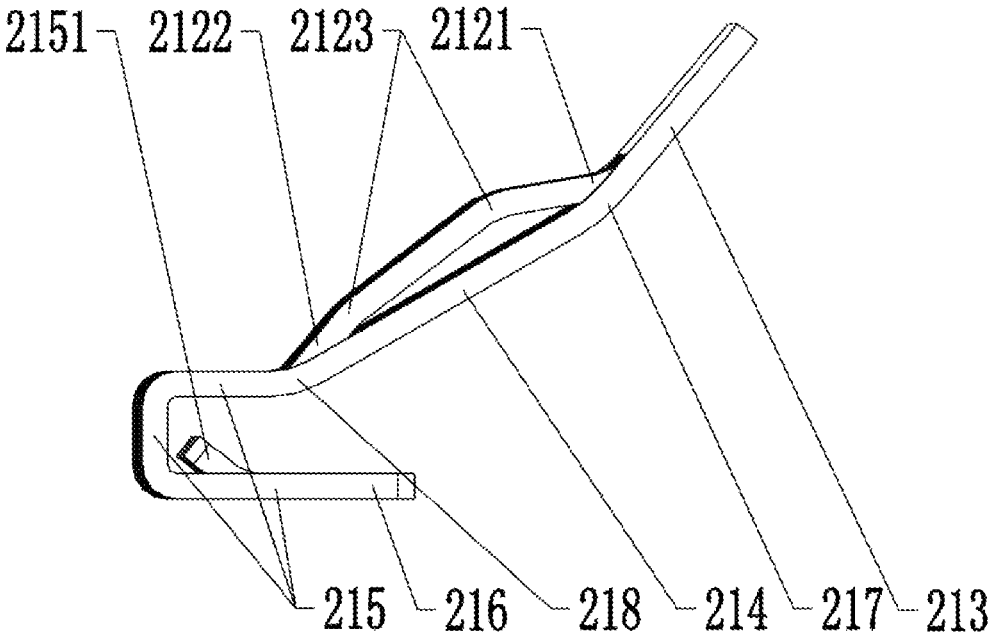
FIG. 8 is a schematic view of the conductive clip of the connection terminal in FIG. 7.

Specifically, the elastic tongue 212 has a connecting end 2121 fixed to the spring steel plate and a free end 2122 extending close to the wire passage 211. Moreover, from the connecting end 2121 to the free end 2122, the elastic tongue 212 has an arch-shaped bending structure, and at least two linear bending sections 2123 are provided to be folded back to the crimping wire A by pre-deformation. Among them, the arch-shaped bend of the elastic tongue 212 (having the bending section 2123) and the arch-shaped bend formed by the supporting section 213 and the tongue forming section 214 are opposite to each other (as shown in FIGS. 4 and 8). The elastic tongue punched out of the spring steel plate can be pre-deformed, and from its connecting end 2121 to the free end 2122, it is folded back to the crimping wire A through at least two linearly bent bending sections 2123. Moreover, each bending section 2123 bends towards the crimping wire A along the turning point, and has at least two bends back to the elastic pressing wire A, which greatly improves the elastic abutment of the elastic tongue 212 and realizes more stable clamping. Moreover, the arch-shaped bending structure of the elastic tongue 212 is opposite to the arch-shaped bending structure formed by the conductive clip 21, and the arched portions of the two bending structures are outwardly arranged to face each other, so that the elastic tongue 212 bends towards the direction of the crimping wire A, and the conductive clip 21 is expanded and bent outwardly.

In this embodiment, the openings of the conductive clips 21 are expanded outwardly by orientation of the first elastic arch 217 and the second elastic arch 218 towards the conductor A. Correspondingly, the elastic tongue 212 is an arch-bridge like bent structure, and has at least two bending sections 2123 that are pre-deformed and folded back to the crimping wire A, so that the arched bend of the elastic tongue 212 faces the arched bend formed by the supporting end and by the tongue forming section 214 of the conductive clip 21. The conducting wire A elastically crimped at the free end 2122 of the elastic tongue 212 is subjected to the common elastic bending action of the two arch bends.

When the conducting wire A with insulation sheath peeled off is inserted into the wire passage 211 along the insertion hole 31 and elastically crimped in the clamping space, the arch-bridge shaped bend of the elastic tongue 212 makes the end of the conducting wire A abuts and drives the free end 2122 of the elastic tongue 212 to be lifted upwards, and at the same time, the elastic tongue 212 is disposed on another arch-bent tongue forming section 214, which correspondingly drives the conductive clip 21 to be pre-deformed outwardly, so as to facilitate the positive insertion and installation of the conducting wire A. When the conducting wire A is elastically crimped in the clamping space, it is twisted and pulled in the opposite direction of the insertion direction of the conducting wire A to disengage from the inside of the connection terminal. At this time, the free end 2122 of the elastic tongue piece 212 bent in an arch-bridge shape and elastically crimped on the conducting wire A presses the conducting wire downward elastically, and drives the tongue forming section 214 to make the conductive clip 21 pre-deformed inwardly to clamp the conducting wire A in the clamping space. In this way, a clamping force is provided that prevents the conducting wire A from pulling out, further ensuring stable connection of the conducting wire A in the clamping space, which satisfies twist and pull test of the conducting wire A in the connection terminal.

In the present embodiment, the end of the free end 2122 is located outside the cavity formed by the approximately C-shaped cavity section 215 in the initial state. Moreover, the free end 2122 and the connection end 2121 have a height difference, and insertion of the conducting wire A into the wire passage 211 correspondingly reduces the height difference. The elastic tongue formed by punching corresponds to a window gap 2141 formed on the spring steel plate in the tongue forming section 214, and the window gap 2141 communicates with the corresponding wire passage 211. The free end 2122 of the elastic tongue 212 is accommodated between the window gap 2141 and the wire passage 211, and the end of the free end 2122 is located outside the cavity, so that the lowest point of the end is still located at the position of the window gap 2141 and avoids protruding into the cavity of the approximately C-shaped cavity section 215, further ensuring quick insertion of the stripped wire A in a convenient and labor saving way. In addition, the elastic tongue is bent from the top to the bottom along a direction from the connecting end 2121 to the free end 2122, so that a height difference is formed between the two ends. Inserting of the conducting wire A into the wire passage 211 and being pressed in the clamping space drive the elastic tongue to be lifted up, and the height difference still existing becomes smaller as the elastic tongue is lifted up, correspondingly increasing the pulling force when the conducting wire A needs to be pulled out, thereby stabilizing connection of the conducting wire A in the clamping space.

In this embodiment, elastic protrusions 2151 are correspondingly arranged inside the approximately C-shaped cavity section 215 corresponding to the wire passages 211, and the bus bar 22 inserted in the wire passages 211 is supported on the elastic protrusions 2151. The elastic protrusions 2151 are formed on the conductive clip 21 by punching and are provided on the insertion path of the conducting wire A. Each of the elastic protrusions 2151 is bent upward and arranged spaced at the same position of each wire passage 211. When the support member 3 is assembled to the housing 1 and the contact assembly 2 is supported in the mounting cavity 11, the bus bar 22 is placed in the conductive clip 21 and supported on each elastic protrusion 2151 to evenly and elastically abut the bus bar 22 in a direction towards the conducting wire A, so that the conducting wire A is in a clamping state where it is elastically pressed up and down in the clamping space. Among them, the elastic protrusion 2151, the wire passage 211 and the elastic tongue 212 correspond one-to-one with each inserted conducting wire A. The conductive clip 21 is provided with a plurality of cooperating wire passages 211, elastic protrusions 2151 and corresponding elastic tongues 212, so that the conducting wires A inserted into the wire passages 211 can be connected in parallel.

Figure 9:
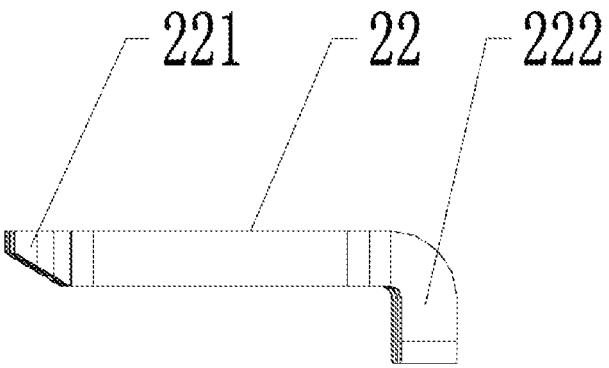
FIG. 9 is a schematic structural view of the bus bar of the connection terminal in FIG. 7.
Figure 10:
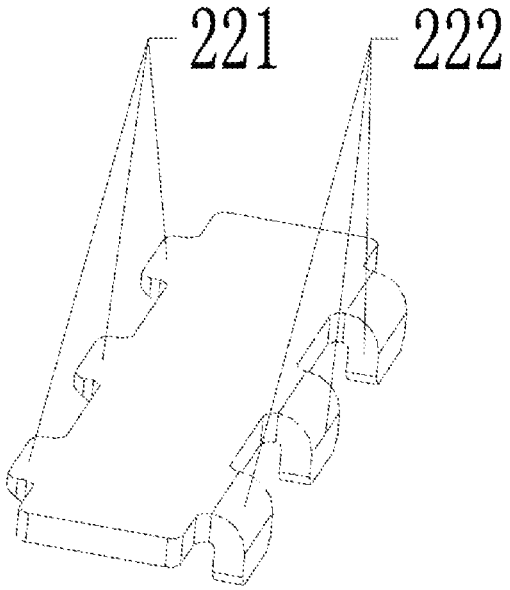
FIG. 10 is a schematic view of the bus bar in FIG. 9 from another perspective.
Figure 11:
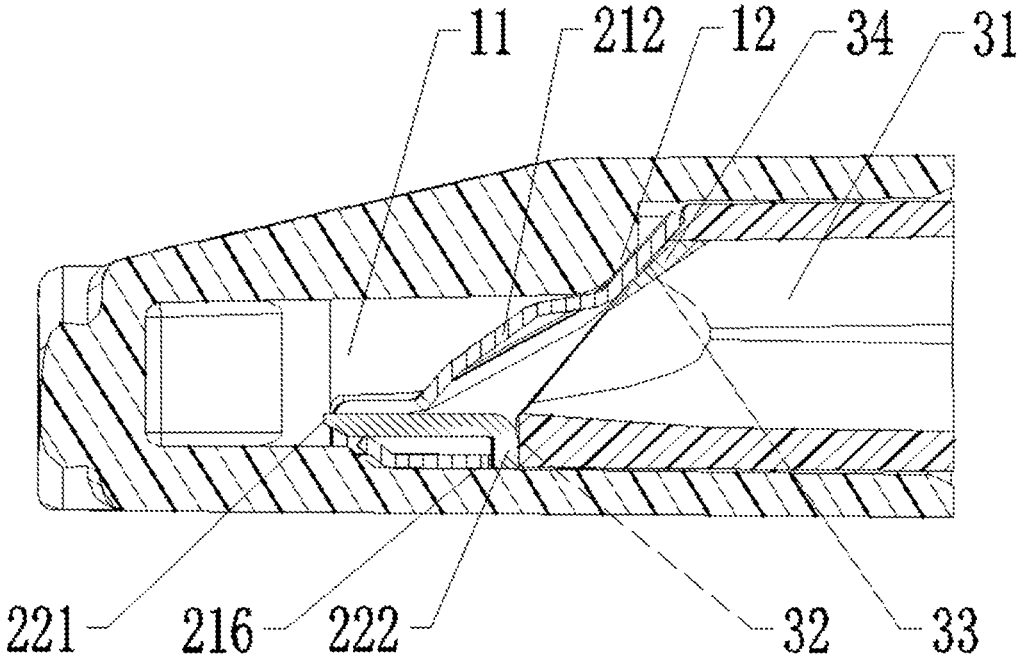
FIG. 11 is a cross-sectional view of the connection terminal in FIG. 7, in which the conducting wire is not clamped into the connection terminal.
Figure 12:
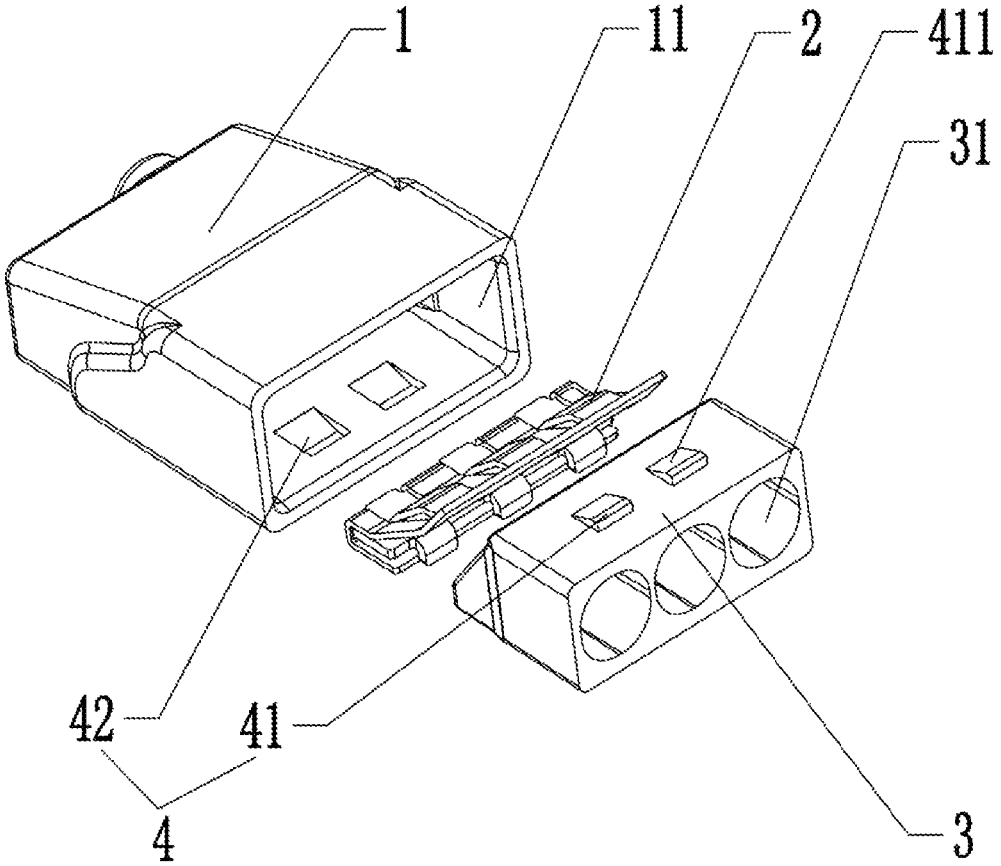
FIG. 12 is a schematic view of the connection terminal of the embodiment of the present disclosure in a partially disassembled state.
Figure 13:
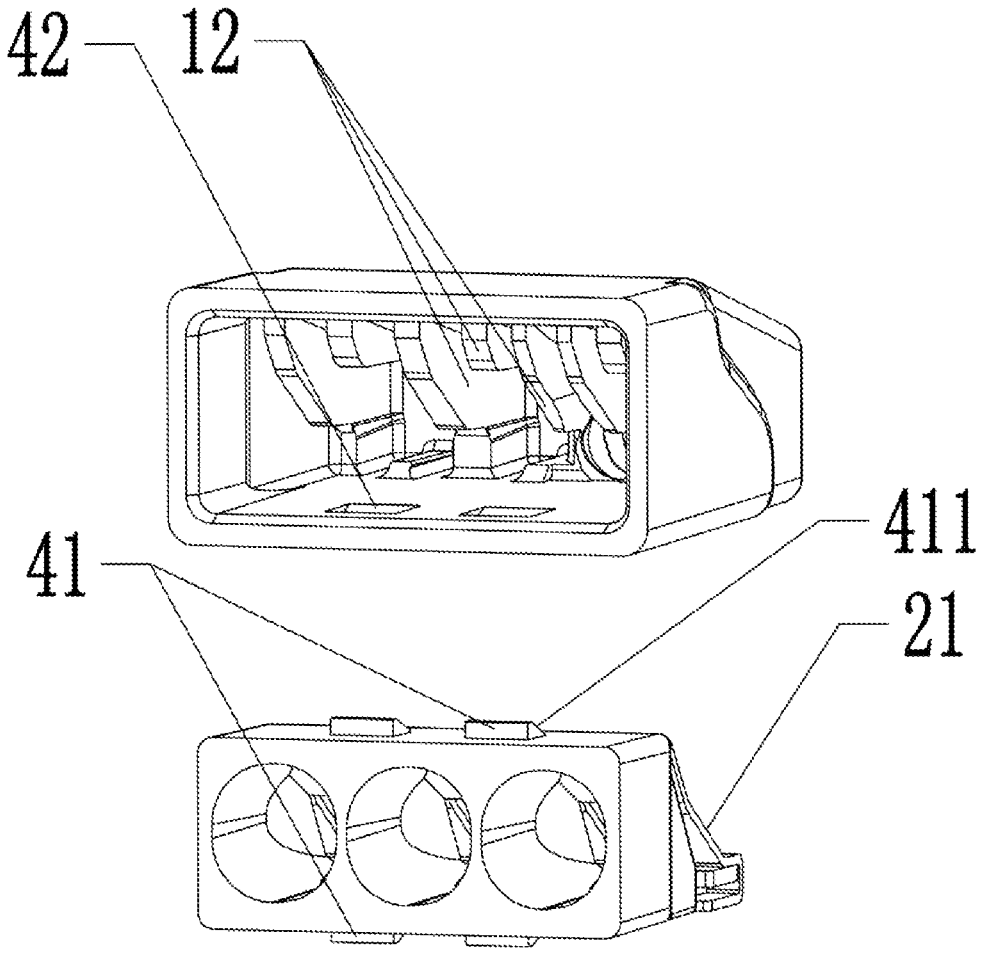
FIG. 13 is a schematic view of the connection terminal of the embodiment of the present disclosure in a partially disassembled state from another perspective.
Figure 14:
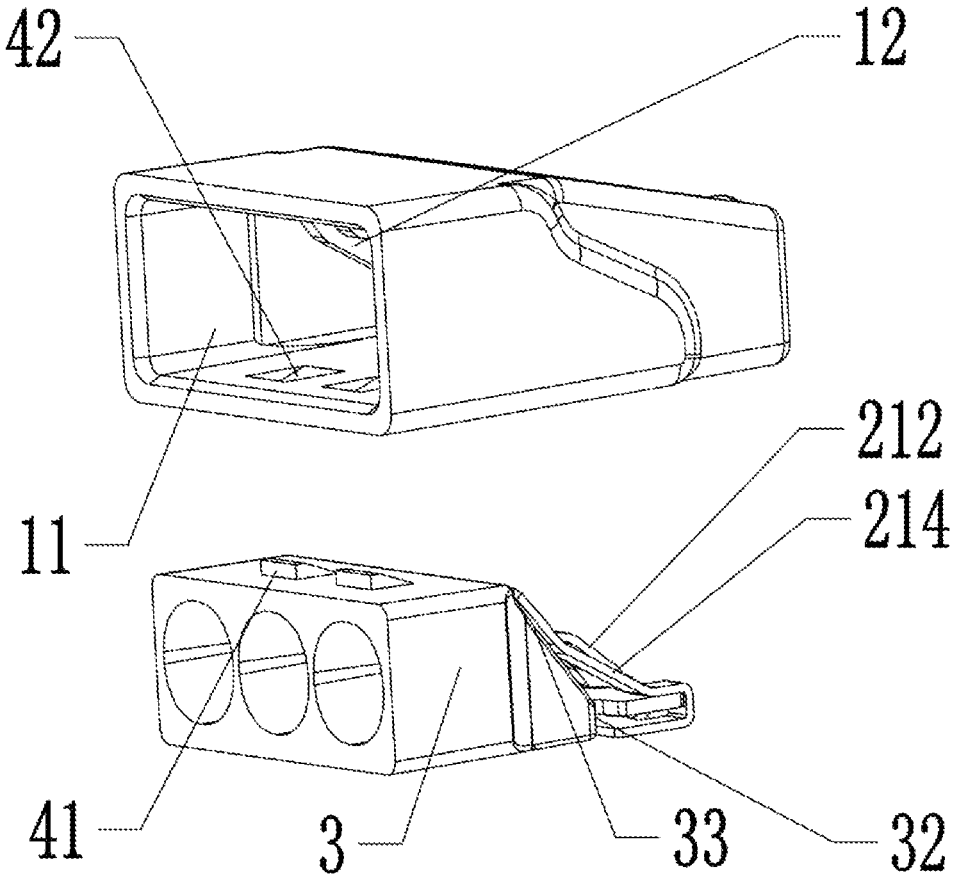
FIG. 14 is a schematic view of FIG. 13 in a disassembled state from another perspective.

Referring to FIGS. 9 to 11, the bus bar 22 is formed by bending through a conductive sheet structure. The bus bar 22 has a head 221 that cooperates with the wire passage 211 and extends outside the passage, and a bent portion 222 disposed on a side away from the head 221. The bent portion 222 is supported and disposed in the housing 1 and is assembled into the mounting cavity 11 via the support member 3 to abut and drive the bent portion 222 to fix the bus bar 22 horizontally in the conductive clip 21 in the direction in which the conducting wire A is inserted, so that the conductive clip 21 and the bus bar 22 form a clamping space for elastically crimping the conducting wire A.

In this embodiment, the bus bar 22 is provided with a bent portion 222 away from its head, and the head and front and back sides of the bus bar 22 can be conveniently distinguished, which is convenient for rapid sorting by machine or manual and prevents inconvenient installation and assembly errors during the process that the bus bar 22 is inserted and mated to the connection terminal. Moreover, the bent portion 222 is supported and arranged in the housing 1. When the support member 3 is assembled into the mounting cavity 11, it abuts the bent portion 222 so that the bus bar 22 is stably placed in the conductive clip 21, ensuring that the conductive clip 21 and the bus bar 22 form a more stable crimping space.

In one embodiment, a plurality of heads 221 of the bus bar 22 are arranged at intervals, and correspond one-to-one to the wire passages 211 opened in the conductive clip 21. The bus bar is disposed in the conductive clip 21 along the insertion direction of the conducting wire A, and the heads 221 at least partially protrude out of the conductive clip 21 through the wire passages 211. When the bus bar 22 is assembled into the mounting cavity 11, the heads 221 are at least partially exposed outside of the conductive clip 21, and are provided protrudingly along the insertion direction of the conducting wire A, effectively ensuring contact of the conducting wire A in the clamping space. Among them, the bent portions 222 correspond to the heads 221 one by one, and the heads 221 and the bent portions 222 are directly opposite to two sides of the bus bar 22. The heads 221 and the bent portions 222 located at the front and rear sides make man-machine sorting more efficient and convenient. Moreover, each wire passage extends with a head 221, and each head 221 corresponds to a bent portion 222, which ensures the crimping contact of the contact assembly 2. Further, support of the plurality of bent portions 222 makes the bus bar 22 firmly located in the conductive clip 21.

In this embodiment, the bent portion 222 is vertically bent relative to the bus bar 22, so that the cross section of the bus bar 22 where the bent portion 222 is located has an L shape, and the head 221 and the bent portion 222 are at both ends of the L shape. The bus bar 22 is horizontally laid in the conductive clip 21 so that the bent portion 222 is vertically supported in the housing 1 and is sandwiched between the support member 3 and the conductive clip 2. The support member 3 has a mating surface 32 which is in contact with the bent portion 222. By the support member 3 fitting into the mounting cavity 11, one side surface of the bent portion 222 supported in the housing 1 abuts against the mating surface 32 with each other in a way of surface contact, and the other side surface of the bent portion 222 abuts against the lower end of the conductive clip 21. The bent portion 222 is supported in the housing 1 and is relatively stable under the clamping of the mating surface 32 and the extension section 216 of the conductive clip 21. The bus bar 22 is interposed between the support member 3 and the conductive clip 21 through the bent portion 222, which makes the assembly of the bus bar 22 more stable and avoids situations like assembly error of the bus bar 22 in the conductive clip 21 due to mere support by the support part.

It should be mentioned that elastic protrusions 2151 are provided on the end surface of the conductive clips 21 facing the bus bar 22, so that the bus bar 22 inserted in the wire passages is supported on the elastic protrusions 2151. The elastic protrusions 2151 are provided in the insertion path of the conducting wires A, and are disposed at the same position of each wire passage at intervals. The elastic protrusions 2151, the wire passages 211 and the elastic tongues 212 are in one to one correspondence with each inserted conducting wire A. The elastic protrusion protrudes upwardly near the head 221, thereby providing the bus bar 22 with a uniform elastic abutment force along the direction close to the conducting wire A.

Referring to FIG. 11 to FIG. 14, the support member 3 is detachably arranged in the mounting cavity 11 through the quick release structure 4. Among them, the quick release structure comprises a convex block 41 and a clamping slot 42 adapted to the convex block 41. One of the housing 1 and the support member 3 is provided with the convex block 41, and the other is provided with the clamping slot 42 correspondingly. The support member 3 is assembled into the mounting cavity 11, and correspondingly, the convex block 41 is clamped and placed in the clamping slot 42. Moreover, the convex block 41 is provided with an inclined guide surface 411 along the assembling direction, and the support member 3 is quickly disassembled and assembled through the inclined guide surface 411.

In this embodiment, the quick release structure 4 enables quick assembly and disassembly between the housing 1 and the support member 3, which realizes efficient assembly of the connection terminals and is convenient for assembly and disassembly and maintenance during daily use. Among them, since the quick release structure 4 is provided with any one of the convex block 41 and the clamping slot 42 which are matched with each other and are respectively arranged on the housing 1 and the support member 3, the disassembly and assembly of the support member 3 in the housing 1 is facilitated. The contact assembly 2 is disposed in the mounting cavity of the housing 1 to substantially closes the opening of the mounting cavity 11 via the support member 3, and only an insertion hole 31 is opened for inserting the conducting wire A into the connection terminal and connecting with the contact assembly 2. Moreover, the convex block 41 is provided with an inclined guide surface 411 along the assembly direction, and the inclined guide surface 411 is relatively inclined, so that the convex block 41 has a wedge shape. Guide by the inclined guide surface 411 during the assembly process facilitates quick assembly and disassembly of the support member 3 in the housing 1.

In one of the embodiments, the convex blocks 41 are disposed on the support member and are located at the upper and lower end surfaces of the support member 3 respectively, and the clamping slots 42 are correspondingly provided on the inner wall of the mounting cavity 11 of the housing 1. Specifically, the inclined guide surface 411 is disposed at the end surface of the support member 3, and the inclined guide surface 411 is inclined in the direction in which the conducting wire A is inserted. The convex block 41 on the upper end surface has its inclined guide surface 411 inclined downward. The convex block 41 on the lower end surface has an inclined guide surface 411 inclined upward. Both inclined guide surfaces 411 are inclined along the direction in which the conducting wire A is inserted, so as to facilitate the quick engagement of the convex block 41 along the inclined surface into the clamping slot 42. It should be noted that the housing 1 is made of plastic material, and nylon PA66 material can be selected, which has strong flame retardancy, insulation and impact resistance. Moreover, the housing 1 provided with the mounting cavity 11 is hollow inside, and the clamping slot 42 is opened on the outer side of the inner wall, so that the convex block 41 is locked to the clamping slot 42. When the user passes external force to squeeze at the position of the housing 1 where the inner wall is located, the hollow housing 1 can be slightly deformed under squeezing, so that the clamping slot 42 is displaced relative to the protrusion 41. At this time, the protrusion 41 and the clamping slot 42 are disengaged from each other by pulling force in a direction opposite to the assembly of the support member 3, so that the support member 3 is quickly detached.

In this embodiment, a plurality of ribs 12 are arranged on the inner wall of the mounting cavity 11 directly facing the contact assembly 2. The ribs 12 protrude along the mounting cavity 11 and are in clearance fit with the contact assembly 2. The ribs 12 are in clearance fit with the conductive clip 21 of the contact assembly 2 and the elastic tongue 212 bent in the shape of an arch bridge and provided at the conductive clip 21, and the distance between the elastic tongue and the corresponding rib 12 is comparatively large. The end surfaces of the conductive clips forming the elastic tongues 212 are facing to and spaced apart from the ribs 12 located in the mounting cavity 11, wherein the gaps between the elastic tongues 212 and the facing ribs 12 are larger than that between end surfaces of other conductive clips 21 and the facing ribs 12. When the conducting wire A is inserted into the wire passage 211 along the insertion hole 31 and is elastically pressed into the clamping space, the free end 2122 of the elastic tongue 212 is lifted upward. As a result, the distance between the elastic tongue 212 and the corresponding rib 12 becomes smaller. At this time, the distance between the raised elastic tongue 212 and the rib 12 is equal to the distance between other end surface of the conductive clip 21 and the rib 12. The rib 12 in the mounting cavity 11 plays a role of protecting the conductive clip 21 and preventing the conductive clip 21 from being deformed too much under abutment and support of the support member 3.

It should be mentioned that an abutment surface 33 is provided on a side surface of the support member 3 abutting and supporting on the conductive clip 21. The abutment surface 33 is opposed to the opening of the conductive clip 21 to stretch the conductive clip 21 so that the conductive clip 21 is spaced from the rib 12. The abutment surface 33 (front end surface) of the support member 3 that abuts and support on the conductive clip 21 is provided with a partition part corresponding to the last segment of the elastic tongue 212, and the partition part 34 is located between the elastic tongue 212 and the insertion hole 31. In this embodiment, the conducting wire A is inserted into the wire passage 211 by crimping and clamping between the conductive clip 21 and the bus bar 22. In this process, since the partition part 34 corresponds to the connection end of the elastic tongue and provided between the elastic tongue 212 and the insertion hole 31, the partition part 34 can protect the end of the elastic tongue and prevent the elastic tongue from deforming or losing elasticity during frequent cooperation with the conducting wire A. Moreover, the partition part 34 may have a sheet like structure formed at the front end of the support member 3.

The above is only some embodiments of the present disclosure, and is not intended to limit the present disclosure. To those of ordinary skill in the art, various modifications and changes can be made to the present disclosure. Any modifications, equivalent substitutions, improvements, etc. made within the spirit and scope of the present disclosure are intended to be included within the scope of the present disclosure.

What is claimed is:

1. A connection terminal for electrically connecting at least two conducting wires, the connection terminal comprising a housing provided with a mounting cavity, a contact assembly arranged in the mounting cavity, and a support member detachably arranged in the mounting cavity and provided with insertion holes;

the contact assembly comprises a conductive clip and a bus bar, the conductive clip is provided with at least two wire passages and elastic tongues corresponding to the at least two wire passages, and the bus bar is inserted into the at least two wire passages and supported in the housing; the conductive clip is arranged in the mounting cavity with an opening facing the support member and is assembled to the mounting cavity via the support member; the conducting wires with insulation sheath peeled off can pass through the insertion holes in such a way that the conducting wires are located between the conductive clips and the bus bar and be inserted into the at least two wire passages, so that the elastic tongues are pressed upon the conducting wire;

wherein the conductive clips are integrally formed, and each has a supporting section, a tongue forming section, an approximately C-shaped cavity section and an extension section that are connected in sequence;

wherein the supporting section abuts against the support member, and the supporting section and the tongue forming section are connected by a pre-deformed first elastic arch; the elastic tongues spaced apart each is formed by punching of the tongue forming section, the tongue forming section is connected to one end of the approximately C-shaped cavity section through a pre-deformed second elastic arch, the other end of the approximately C-shaped cavity section extends horizontally with an extension section, and the at least two wire passages communicate with an interior of the approximately C-shaped cavity section;

wherein two ends of the tongue-forming section are respectively connected to the supporting section and the approximately C-shaped cavity section through the pre-deformed first elastic arch and the pre-deformed second elastic arch respectively, so that a clamping space can be formed between the conductive clip and the bus bar, and the conducting wires with insulating sheath peeled off can be elastically pressed in the clamping space;

wherein the bus bar is formed by bending through a conductive sheet structure, the bus bar has a plurality of heads that cooperates with the at least two wire passages and extends outside the passage and a plurality of bent portions disposed on a side away from the plurality of heads;

the bent portion is supported and disposed in the housing, and is assembled into the mounting cavity via the support member to abut and drive the bent portion to fix the bus bar horizontally in the conductive clip in a direction in which the conducting wire is inserted, so that the conductive clip and the bus bar form a clamping space for elastically crimping the conducting wire;

the bent portion is bent vertically relative to the bus bar, so that the cross section of the bus bar where the bent portion is located has an L shape; the head and the bent portion are at both ends of the L shape; the bus bar is horizontally laid in the conductive clip so that the bent portion is supported vertically in the housing and is sandwiched between the support member and the conductive clip; the support member has a mating surface which is in contact with the bent portion; by the support member fitting into the mounting cavity, one side surface of the bent portion supported in the housing abuts against the mating surface with each other by surface contact, and the other side surface of the bent portion abuts against the lower end of the conductive clip.

2. The connection terminal according to claim 1, wherein arched portions of the first elastic arch and the second elastic arch are oriented towards a direction in which the conducting wires are pressed, so that the opening of the conductive clip can be expanded outwardly.

3. The connection terminal according to claim 1, wherein the elastic tongue has a connection end fixed to the conductive clips and a free end extending close to each of the at least two wire passages, and from the connection end to the free end, the elastic tongue is of an arch-shaped bending structure, and at least two linear bending sections are provided to be pre-deformed and folded back to the conducting wire; wherein the arch-shaped bending of the elastic tongue is arranged to be facing the arch-shaped bending formed by the supporting section and the tongue forming section.

4. The connection terminal according to claim 3, wherein an end of the free end is located outside a cavity formed by the approximately C-shaped cavity section in an initial state, a height difference exists between the free end and the connection end, and the conducting wire is inserted into the at least two wire passages correspondingly, making the height difference smaller.

5. The connection terminal according to claim 1, wherein the elastic tongue formed by punching is provided with a window gap formed on the conductive clips located in the tongue forming section, and the window gap communicates correspondingly to the at least two wire passages.

6. The connection terminal according to claim 1, wherein two ends of the approximately C-shaped cavity section are arranged in parallel, and corners thereof are all connected at an R angle; an interior of the approximately C-shaped cavity is provided with an elastic protrusion corresponding to the at lease two wire passages, and the bus bar inserted into the at lease two wire passages is supported on the elastic protrusion.

7. The connection terminal according to claim 6, wherein the elastic protrusion, the at lease two wire passages and the elastic tongue correspond to each inserted conducting wire in one-to-one correspondence.

8. The connection terminal according to claim 1, wherein a plurality of heads of the bus bar are arranged at intervals, and correspond one-to-one to the at least two wire passages opened in the conductive clip; the bus bar is disposed in the conductive clip along the insertion direction of the conducting wire, and the heads at least partially protrude out of the conductive clip through the at least two wire passages.

9. The connection terminal according to claim 8, wherein the bent portions are corresponded to the heads one by one; the heads and the bent portions are directly opposite to two sides of the bus bar.

10. The connection terminal according to claim 1, wherein the support member is detachably arranged in the mounting cavity through a quick release structure; the quick release structure comprises a convex block and a clamping slot adapted to the convex block; one of the housing and the support member is provided with the convex block, and the other is provided with the clamping slot correspondingly; the support member is assembled into the mounting cavity, and correspondingly, the convex block is clamped and placed in the clamping slot; the convex block is provided with an inclined guide surface along the assembling direction, and the support member is quickly disassembled and assembled through the inclined guide surface.

11. The connection terminal according to claim 10, wherein the convex blocks are disposed on the support member and are located at the upper and lower end surfaces of the support member respectively; and the clamping slots are correspondingly provided on the inner wall of the mounting cavity of the housing.

12. The connection terminal according to claim 11, wherein the inclined guide surface is disposed at the end surface of the support member, the convex block has a wedge shape, and the inclined guide surface is inclined in the direction in which the conducting wire is inserted.

13. The connection terminal according to claim 11, wherein the housing is made of plastic material; the housing provided with the mounting cavity is hollow inside, and the clamping slot is opened on the outer side of the inner wall.

14. The connection terminal according to claim 10, wherein a plurality of ribs are arranged on the inner wall of the mounting cavity directly facing the contact assembly; the ribs protrude along the mounting cavity and are in clearance fit with the contact assembly; the ribs are in clearance fit with the conductive clip of the contact assembly and the elastic tongue bent in the shape of an arch bridge and provided at the conductive clip, and the distance between the elastic tongue and the corresponding rib is comparatively larger than the distance between the contact assembly and the corresponding rib.

15. The connection terminal according to claim 14, wherein an abutment surface is provided on a side surface of the support member abutting and supporting on the conductive clip; the abutment surface is opposed to the opening of the conductive clip to stretch the conductive clip so that the conductive clip is spaced from the rib.

16. The connection terminal according to claim 1, wherein a front end surface of the support member that abuts against the conductive clip is provided with a partition part corresponding to an end of the elastic tongue, and the partition part is located between the elastic tongue and the insertion hole.

* * * * *